United States Patent [19]

Sizemore

[11] 4,429,508

[45] Feb. 7, 1984

[54] ANCHORING DEVICE FOR METAL ROOF

[76] Inventor: Charlie B. Sizemore, Rte. 10 Mesa Dr., Kingsport, Tenn. 37663

[21] Appl. No.: 312,691

[22] Filed: Oct. 19, 1981

[51] Int. Cl.[3] ..... E04B 1/38

[52] U.S. Cl. ..... 52/713; 52/410; 52/486

[58] Field of Search ..... 52/712, 713, 410, 404, 52/90, 407, 486

[56] References Cited

U.S. PATENT DOCUMENTS 4,213,282 7/1980 Heckelsberg ..... 52/410 X

*Primary Examiner*—John E. Murtagh

*Assistant Examiner*—Kathryn L. Ford

[57] ABSTRACT

A device for anchoring a metal roof to a metal building composed of an upper part which is secured to the metal roof and slidably engaged with a lower part which is secured to the metal building.

6 Claims, 6 Drawing Figures

ANCHORING DEVICE FOR METAL ROOF

This invention relates to an anchoring device for slidably attaching a metal roof to a structural member during construction of a metal building.

As is well known in the art a metal building is composed of a frame of metal structural members over which wall panels and roof panels are secured by anchoring devices. The wall and roof panels are of various design but typically have some type of rib cross section.

There are two basic types of metal roofs. One type is the so-called "rib" type where the sides of adjacent panels are joined by overlapping the sides of the adjacent panels and securing both panels to the structural member supporting the roof by a securing means, such as a self-tapping sheet metal screw, located in the flat pan of the roof.

Another type of roof is the so-called "standing seam" type roof where adjacent panels are permanently joined by forming the edges into a seam, usually by rolling. An anchoring device is typically secured in the seam and fastened to the structural member by a self-tapping sheet metal screw.

Although metal buildings have many advantages such as cost and ease of construction, one problem associated with metal buildings is dimensional changes in the roof and walls due to changes in temperature. Since these panels generally have a rib cross section, dimensional changes are a problem only in the direction parallel to the run of the rib. In the direction perpendicular to the run of the rib the panel merely deflects as a result of dimensional changes. Since the dimensional change problem is proportional to total length of all panels, the problem is more acute in roofs than in walls. The problem has largely been solved in standing seam roofs by slidably mounting the roof so that the entire roof is free to move in the direction parallel to the run of the rib. Various schemes are used to achieve this freedom of movement, such as allowing the portion of the anchoring device attached to the roof to move in a slot in the portion of the anchoring device attached to the structural member.

The anchoring device of this invention is a slot-type device which can be broadly thought of as composed of a lower part which is secured to the structural member and an upper part which is slidably engaged with the lower part and is secured to the roof upon installation of the roof. The upper part is attached to the lower part by inserting a tab-like portion of the upper part into a slot in the lower part so as to engage the tab-like portion in the slot and securing the upper part in close proximity to the lower part by use of projections on the upper part.

One advantage of this invention is the ease with which the slidable part to be secured to the roof can be secured in the slot of the stationary part attached to the structural member.

Another advantage of this invention is the ease with which roof panels can be replaced, since the roof panel can merely be unscrewed from the slidable part.

Still another advantage of this invention is that the self-drilling screw used to secure the roof to the building is in the high rib position away from the flow of water.

The anchoring device of this invention can be fully understood by considering the attached drawings.

FIG. 1 shows the end view and FIG. 2 shows the front view.

FIG. 3 is an end view and FIG. 4 is a front view.

Figure 2:
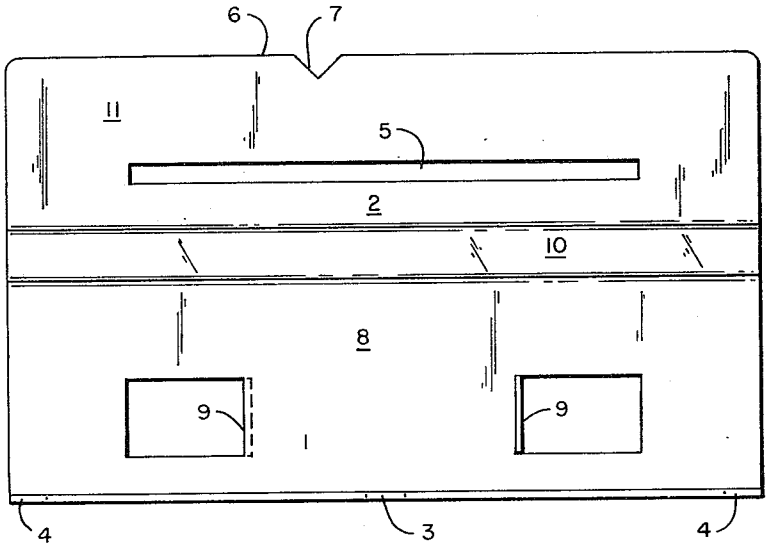
FIGS. 1 and 2 illustrate the stationary member which is attached to the structural member of the building.
Figure 1:
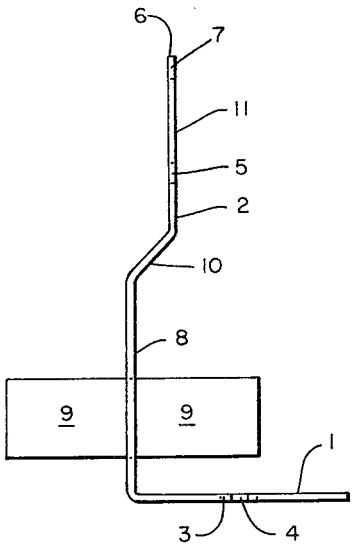

Referring to both FIGS. 1 and 2 there is shown the base portion 1 and upward depending portion 2. Base portion 1 has a hole 3 therein so that the stationary member can be secured to the structural member by a self-tapping sheet metal screw or some other suitable means. Base portion 1 also has slots 4 in each end to aid in properly positioning the stationary member, as will be subsequently explained. Preferably the center line of slots 4 resides on the center line of base portion 1.

Upward depending portion 2 is oriented at an angle of approximately 90° to base portion 1. A slot 5 is oriented so that the long axis of the slot resides in a plane parallel to base portion 1. The top edge 6 of upward depending portion 2 is parallel to the long axis of slot 5. Top edge 6 has a slot 7 therein.

Figure 6:
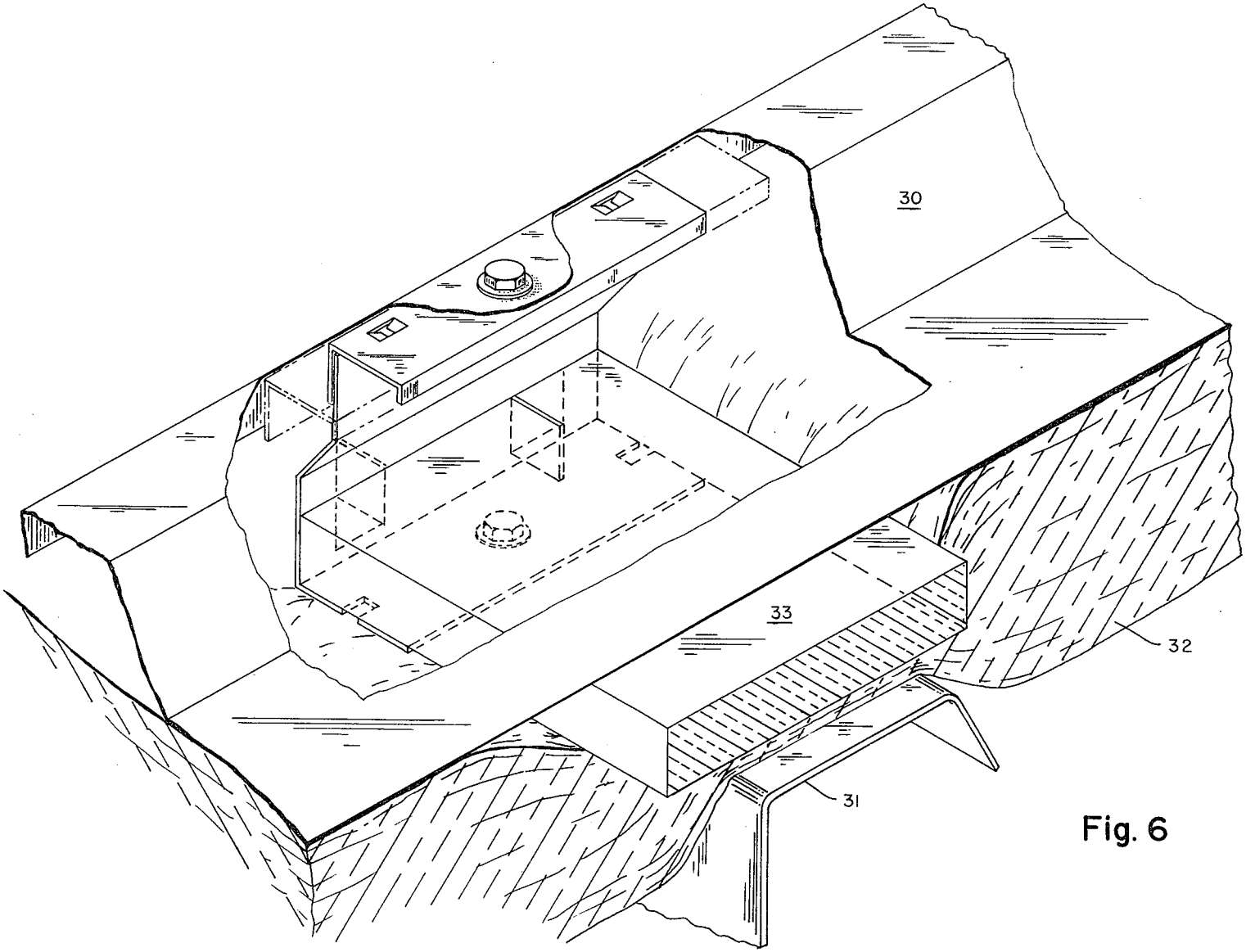
FIG. 6 illustrates the anchoring device being used to slidably attach a metal roof to a structural member. Both a rigid and a nonrigid type of insulation are illustrated.

In the embodiment of the invention illustrated in FIGS. 1 and 2 upward depending portion 2 is further comprised of a lower section 8, having outwardly depending tabs 9 adapted to position a rigid insulating material between the metal roof and the structural member as depicted in FIG. 6.

In the embodiment of the invention shown in FIGS. 1 and 2 upward depending portion 2 is composed of lower section 8, middle section 10 and upper section 11. Lower section 8 is oriented at an angle of approximately 90° to base portion 1. Middle section 10 depends at some suitable angle from lower section 8 to position middle section 10 on the same side of the plane in which lower section 8 resides as base portion 1. Upper section 11 depends at a suitable angle from middle section 10 to orient upper section 11 in a plane parallel to the plane in which lower section 8 resides. Although an angle of around 45° is shown in FIG. 1 the precise angle is not significant.

Figure 4:
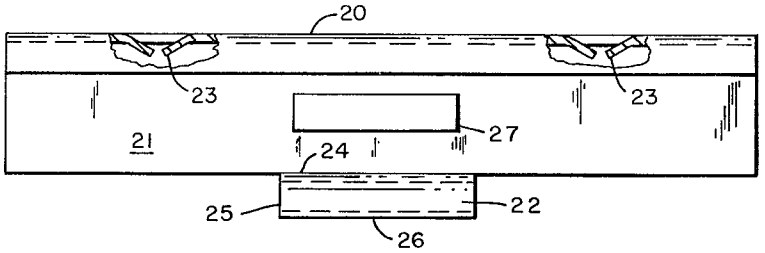
FIGS. 3 and 4 illustrate the slidable member which is attached to the metal roof and slides on the stationary member.
Figure 3:
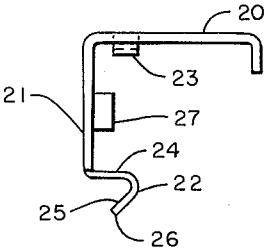

Referring to both FIGS. 3 and 4 there is shown the slidable member adapted to be attached to a metal roof and slide on the stationary member. The slidable member is comprised of a top portion 20, a downward depending portion 21 and an engaging portion 22.

Top portion 20 has downward depending punched projections 23 adapted to allow the slidable member to slide along top edge 6 of upward depending portion 2 of the stationary member by positioning upward depending portion 2 in juxtaposition to downward depending portion 21. The punched projections are of suitable size and shape to pass through notch 7 in top edge 6.

In the embodiment illustrated in FIGS. 3 and 4 two downward depending punched projections are shown but it is fully within the scope of the invention for only one projection to be used.

Downward depending portion 21 is oriented at an angle of approximately 90° to top portion 20.

Engaging portion 22 depends from the lower edge of downward depending portion 21 and has a length which is substantially less than the length of slot 5 in the stationary member.

Engaging portion 22 is comprised of a first piece 24 oriented approximately 90° from downward depending portion 21 and projecting away from the plane in which downward depending portion 21 resides so as to be on the same side of the plane as top portion 20.

Engaging portion 22 is also comprised of a second piece 25 depending toward the plane in which downward depending portion 21 resides. As will be subsequently described in detail, the width of second piece 25 is sufficient to position edge 26 of second piece 25 in slidable engagement with upper depending portion 2 of the stationary member and also is sufficient to position downward depending portion 21 of the slidable member and upward depending portion 2 in parallel arrangement and in juxtaposition.

Optionally a compressible substance 27 can be attached to downward depending member 21 so as to hold the stationary member and the slidable member together during erection of the building.

Figure 5:
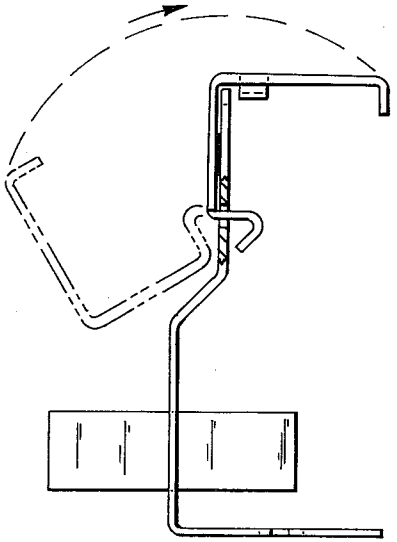
FIG. 5 is an end view of both the stationary member and the slidable member and illustrates the manner in which the slidable member engages with the stationary member.

Referring now to FIG. 5 there is illustrated the manner in which the slidable member is attached to the stationary member. As will be understood by those skilled in the art, second piece 25 of engaging portion 22 is conducted into slot 5. The slidable member is then rotated so that one of projections 23 index with and pass through notch 7. The slidable member is then slid so that both projections 23 cause downward depending portion 21 and upward depending portion 2 to be in a parallel arrangement and in juxtaposition. Insulating material 27 is compressed.

In a preferred embodiment of the invention notch 7 is positioned such that one of projections 23 passes through notch 7 when engaging portion 22 is positioned at the end of slot 5. This is a preferred embodiment because the slidable member can be conveniently slid to the end of slot 5 and one of projections 23 will index with notch 7 so that the projection passes through the notch. When the slidable member is slid to a centered position both projections position the slidable member in the correct position with regard to the stationary member.

Referring now to FIG. 6 there is illustrated the device of this invention being used to slidably secure a metal roof 30 to structural member 31. A nonrigid insulation 32, such as glass fiber, and a rigid insulation 33, such as plastic foam, are being used in accordance with methods well known in the art. The end of rigid insulation 33 has been notched so as to accommodate outwardly depending tabs 9 which position rigid insulating material 33 in place along structural member 31.

The device of this invention can be installed using techniques well known in the art. After the nonrigid insulation is installed over the structural member, the prepunched hole in structural member 31 is located and indexed with the hole in the stationary member. The stationary member is then secured to the structural member by means of a bolt, self-tapping sheet metal screw or other conventional device. Rigid insulation material is then placed over the structural member and the notch in the end indexed with the outward depending tabs. The slidable member is then engaged with the stationary member as previously described. The roof panel is then attached to the slidable member using a self-drilling sheet metal screw or other conventional device.

Slots 4 are useful in positioning the stationary member by use of a template. The template can be used to precisely establish the distance along the structural member from the last anchoring device to the location where the next anchoring device is to be positioned by indexing the slots into projection on the template.

The embodiment of the invention illustrated in the Figures can be thought of as a "C" embodiment because the end view of the device can be thought of as forming a "C". In another embodiment not shown the slidable member can be reversed so that the end view can be thought of as a "Z".

The anchoring device of this invention has been described being used to anchor a roof known in the art as a rib type roof, but the anchoring device can be used to anchor other types of roofs, such as a standing seam roof.

The anchoring device of this invention is made from galvanized sheet metal by punching and forming operations well known in the art. Although a wide variety of gauges can be used, preferably the sheet metal is within the range of 12 gauge to 16 gauge.

I claim:

1. An anchoring device for slidably attaching a metal roof to a structured member comprising, (A) A galvanized sheet metal stationary member comprised of a base portion and an upward depending portion attached to the base portion, (1) the base portion having at least one hole therein adapted to secure the stationary member to the structural member, (2) the upward depending portion oriented at an angle of approximately 90° to the base portion of the stationary member, the upward depending portion having therein a slot, the long axis of the slot residing in a plane parallel to the base portion of the stationary member, the top edge of the upward depending portion being parallel to the long axis of the slot, the top edge having a notch therein, (B) A galvanized sheet metal slidable member adapted to be attached to a metal roof and slide on the stationary member, the slidable member being comprised of a top portion, a downward depending portion and an engaging portion, (1) the top portion having a downward depending punched projection adapted to allow the slidable member to slide along the top edge of the upward depending portion of the stationary member by positioning the upward depending portion in juxtaposition to the downward depending portion of the slidable member, the projection being of size and shape to pass through the notch in the top edge of the upward depending portion of the stationary member, (2) the downward depending portion attached to the top portion at an angle of approximately 90°, (3) an engaging portion attached to the lower edge of the downward depending portion, the engaging portion having a length substantially less than the length of the slot, the engaging portion comprised of, (a) a first piece oriented approximately 90° from the downward depending portion and projecting away from the plane in which the downward depending portion resides so as to be on the same side of the plane as the top portion, (b) a second piece attached to the first piece and depending toward the plane in which the downward depending portion resides, the width of the second piece being sufficient to position the edge of the second piece in slidable engagement with the upper depending portion of the stationary member and also sufficient to position the downward depending portion of the slidable member and the upward depending member of the stationary member in parallel relationship and in juxtaposition, wherein the notch in the top edge of the upward depending portion of the stationary member is positioned such that the downward depending punched projection of the top portion of the slidable member passes through the notch when the engaging portion of the slidable member is positioned at the end of the slot.

2. The anchoring device of claim 1 wherein the galvanized sheet metal is within the range of 12 gauge to 16 gauge.

3. The anchoring device of claim 1 wherein the upward depending portion of the stationary member is further comprised of a lower section, the lower section having outward depending tabs adapted to position a rigid insulating material between the metal roof and the structural member.

4. The anchoring device of claim 1 wherein the upward depending portion of the stationary member is comprised of a lower section, a middle section and an upper secton, the lower section being oriented at an angle of approximately 90° to the base portion of the stationary member, the middle section depending at a suitable angle from the lower section so as to be positioned on the same side of the plane in which the lower section resides as the base portion of the stationary member, the upper section depending at a suitable angle from the middle section to orient the upper section in a plane parallel to the plane in which the lower section resides.

5. The anchoring device of claim 1 wherein the top portion of the slidable member has a second downward depending punched projection.

6. The anchoring device of claim 1 wherein the base portion of the stationary member has a slot in each end, the center line of each slot residing on the center line of the base portion of the stationary member.

* * * * *